US006019279A

United States Patent [19]

Tywoniuk

[11] Patent Number: 6,019,279

[45] Date of Patent: Feb. 1, 2000

[54] PACKAGING CONTAINER MADE OF A CARTON BLANK

[75] Inventor: Andrzej Wieslaw Tywoniuk, Solbergmoen, Norway

[73] Assignee: Elopak Systems Ag, Glattbrugg, Switzerland

[21] Appl. No.: 08/894,162

[22] PCT Filed: Feb. 26, 1996

[86] PCT No.: PCT/IB96/00142

§ 371 Date: Aug. 25, 1997

§ 102(e) Date: Aug. 25, 1997

[87] PCT Pub. No.: WO96/26865

PCT Pub. Date: Sep. 6, 1996

[30] Foreign Application Priority Data

Feb. 28, 1995 [GB] United Kingdom ..... 9503940

[51] Int. Cl.[7] ..... B65D 5/08

[52] U.S. Cl. ..... 229/137; 229/933; 229/184; 229/125.42

[58] Field of Search ..... 229/137, 138, 229/125.42, 933, 139, 184

[56] References Cited

U.S. PATENT DOCUMENTS

| | | | |
|---|---|---|---|
| 4,192,446 | 3/1980 | Naito | 229/137 X |
| 4,332,577 | 6/1982 | Mosse | 229/936 X |
| 4,341,340 | 7/1982 | Lisiecki | 229/936 X |
| 4,667,873 | 5/1987 | Yasui et al. | 229/137 |
| 4,813,546 | 3/1989 | Gordon et al. | 229/125.42 X |
| 4,872,562 | 10/1989 | Wyberg | 229/137 X |
| 5,056,707 | 10/1991 | Larsen | 229/137 X |

*Primary Examiner*—Gary E. Elkins
*Assistant Examiner*—Tri M. Mai
*Attorney, Agent, or Firm*—Reising, Ethington, Barnes, Kisselle, Learman & McCulloch, P.C.

[57] ABSTRACT

A bottom end closure of a carton to be heat- and pressure-sealed has four substantially rectangular panels (P6, P7–P9, P12 and P14–P16) of which the panels (P7–P9 and P14–P16) are divided by score lines (S3, S7 and S13, S17) into inner, triangular sub-panels (P8 and P15) and outer triangular sub-panels (P7, P9 and P14, P16) and have central lugs formed by pairs of small, rectangular sub-panels (P10, P11 and P17, P18) providing for gas-tightness at the apices (A1 and A2) in the sealed closure. Score lines (S4, S6 and S14, S16) provide lines of weakness across the whole widths of the roots of the central lugs, so that the lugs, when each folded upon itself, can adjust to the orientation of an outwardly folded panel (P13) during tucking of the panel (P13) inwards of the lugs, which are sandwiched between the panels (6 and P13). In the blank, the lugs and the panels (P6 and P13) are so dimensioned that they can interdigitate with the corresponding lugs and panels of the bottoms of a row of identical blanks. Edge portions (E11 and E17) of protrusions of the panel (P12) commence adjacent to an parallel with the vertical edges of the panel (P12) and continue convexly curved towards the panel (P13), to co-operate with the folds between the panel (P6), on the one hand, and the sub-panels (P9 and P14), on the other hand, to enhance production and maintenance of self-alignment of the closure.

8 Claims, 11 Drawing Sheets

PACKAGING CONTAINER MADE OF A CARTON BLANK

This invention relates to a packaging container of sheet material and a blank from which the container can be made.

Figure 1:
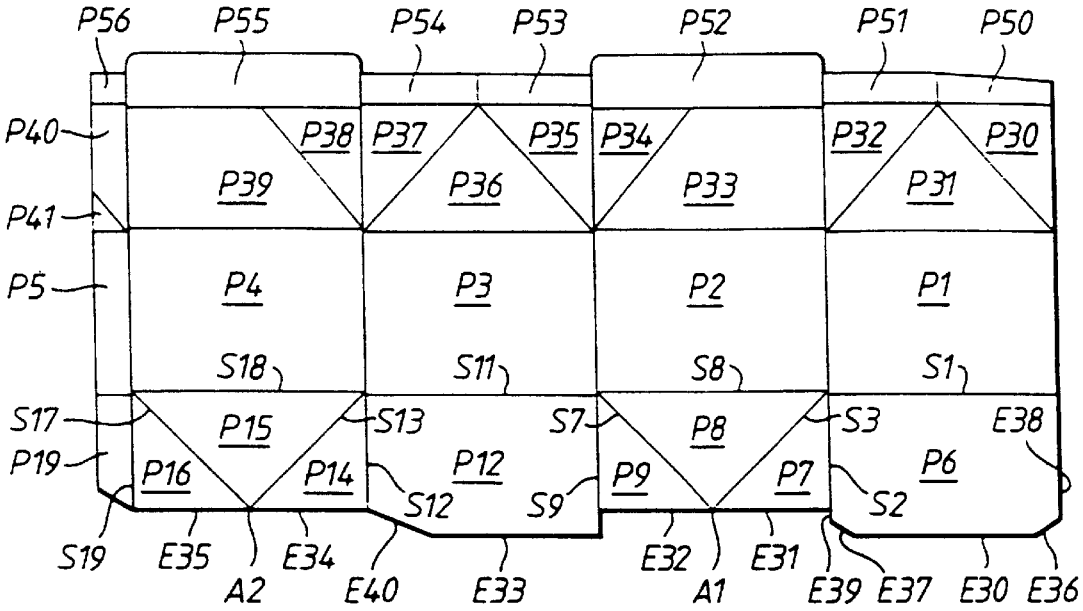
Fig. 1 PRIOR ART
Figure 2:
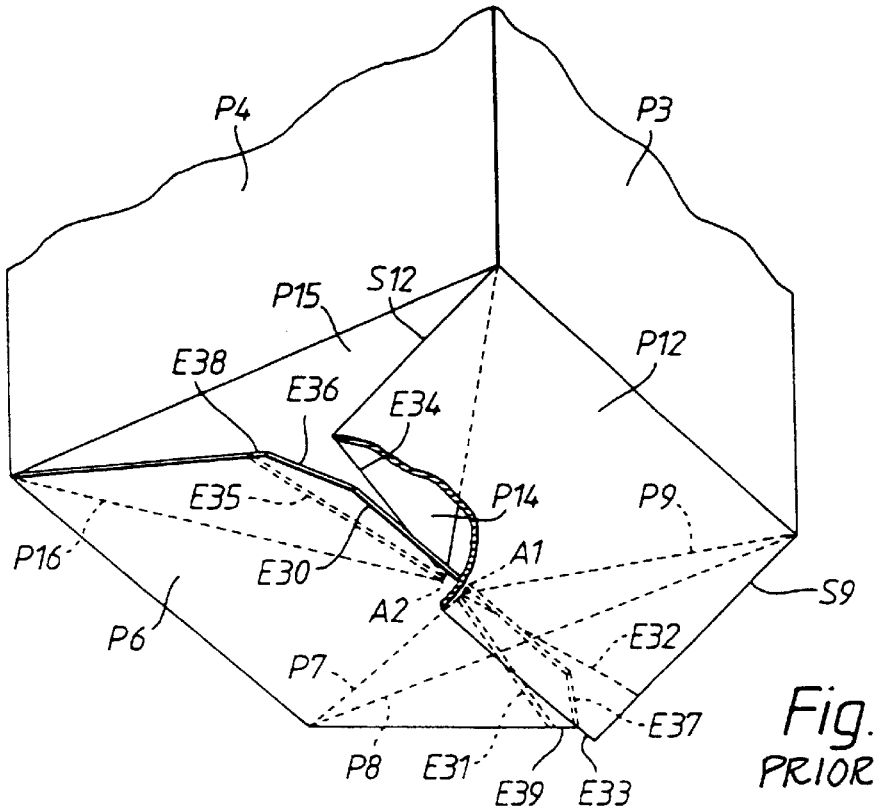
Fig. 2 PRIOR ART

Blanks an cartons according to, or virtually according to, the present FIGS. 1 and 2 are conventional.

U.S. Pat. No. 4,192,446 discloses blanks and cartons according to the present FIGS. 3 and 4.

Figure 5:
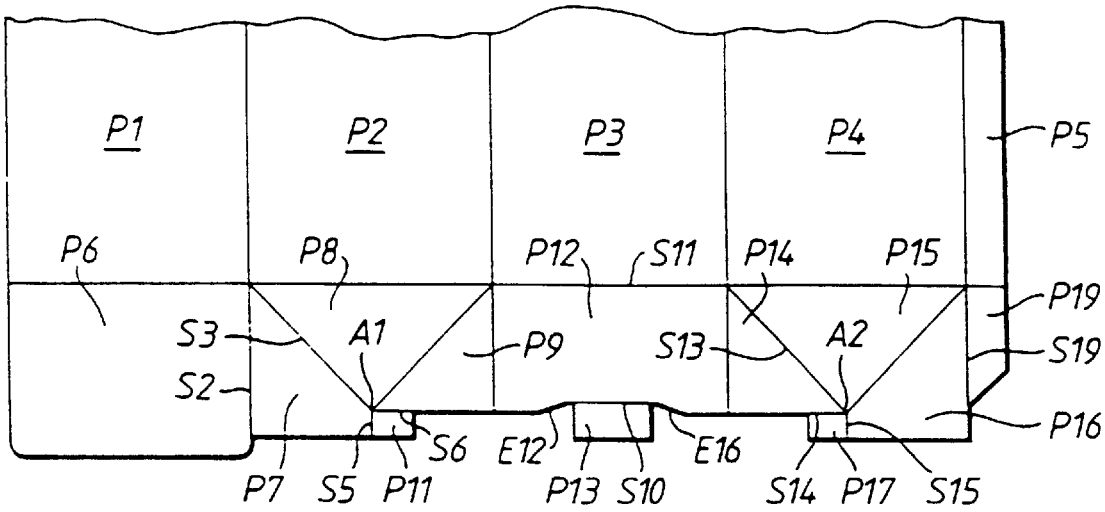
Fig. 5 PRIOR ART
Figure 6:
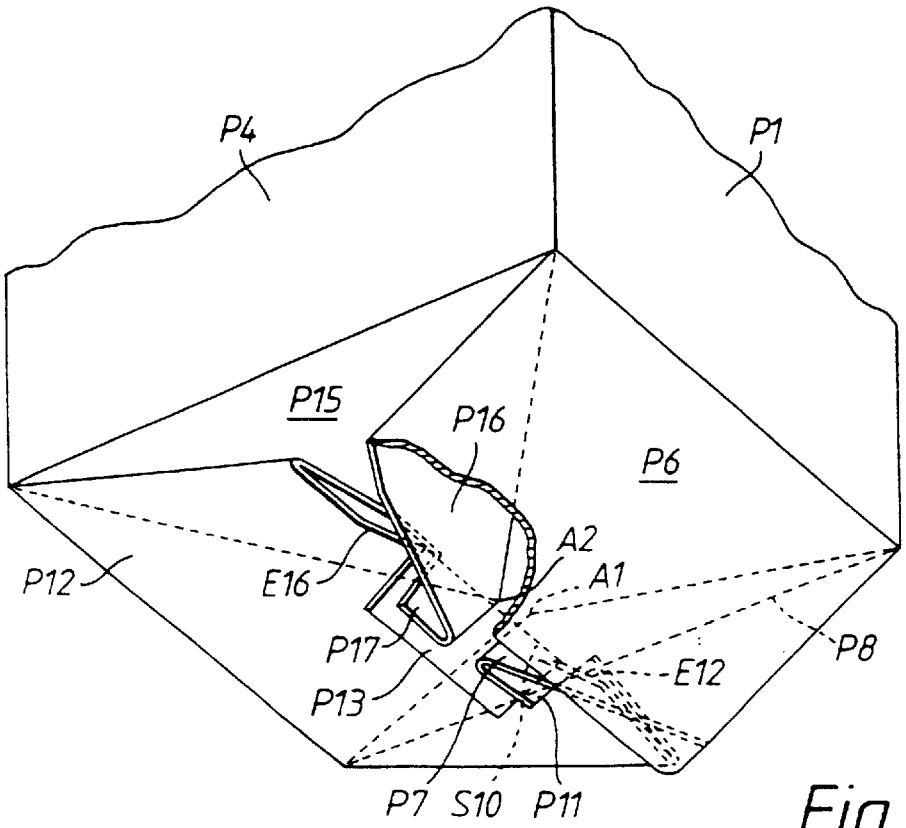
Fig. 6 PRIOR ART
Figure 7:
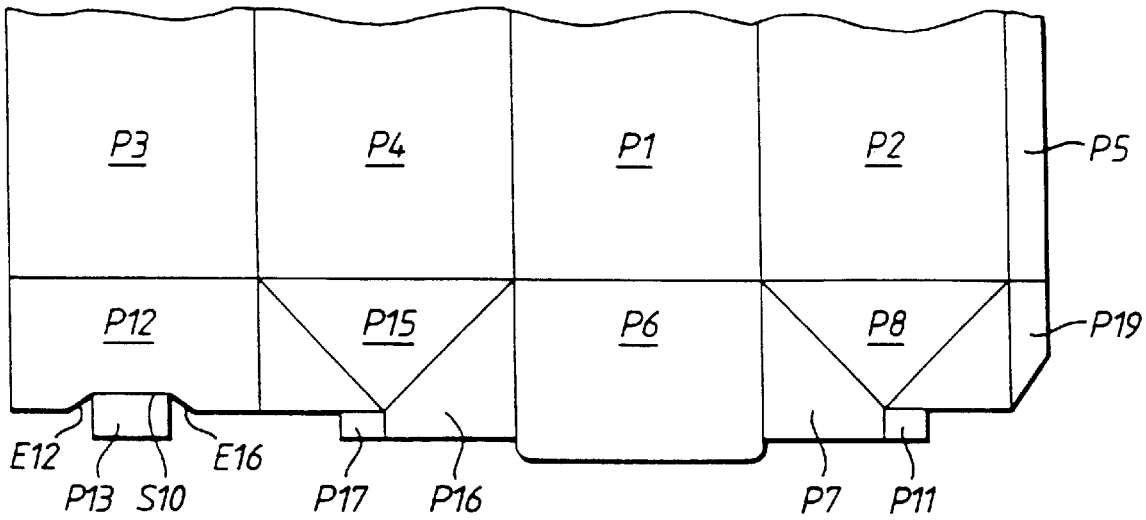
Fig. 7 PRIOR ART

GB-A-2,176,767 discloses blanks and cartons according to the present FIGS. 5 to 7.

According to one aspect of the present invention, there is provided a sheet material blank from which a packaging container is to be made, comprising:

a row of body panels comprised of first, second, third and fourth body panels, and a row of substantially rectangular, end closure panels extending substantially parallelly to said row of body panels and comprised of first, second, third and fourth end closure panels whereof each of the first and third end closure panels has first and second oblique lines of weakness which divide its panel into a central sub-panel of substantially isosceles triangular form and two end sub-panels of substantially triangular form, each of said first and third end closure panels including a central lug projecting centrally outwardly with respect to its panel and thereby bounding respective recesses in the outermost edge zone of its panel, the second end closure panel including a central lug projecting centrally outwardly with respect to its panel, the lugs of the first, second and third end closure panels projecting away from a longitudinal centre line of said row of body panels to substantially the same extent as each other, and the fourth end closure panel projecting from said centre line to at least the same extent as do said lugs, characterised in that said central lug of said second end closure panel bounds respective recesses in the outermost edge zone of it panel, with those recesses being bounded also by respective edges of said second end closure panel which extend in the same general direction as said row of body panels, and in that said lugs of the first, second and third end closure panels and the edge zone of said fourth end closure panel which is furthest from said longitudinal centre line are so dimensioned that such lugs and such edge zones of a first row of blanks identical to said blank can interdigitate with corresponding lugs and corresponding edge zones of a second row of blanks each identical to said blank.

Owing to this aspect of the invention, it is possible to reduce significantly the amounts of waste sheet material produced during production of such blanks, whilst yet providing for gas-tightness of the end closure.

According to a second aspect of the present invention, there is provided a sheet material blank from which a packaging container is to be make, comprising:

a row of body panels comprised of first, second, third and fourth body panels, and a row of substantially rectangular, end closure panels extending substantially parallelly to said row of body panels and comprised of first, second, third and fourth end closure panels whereof each of the first and third end closure panels has first and second oblique lines of weakness which divide its panel into a central sub-panel of substantially isosceles triangular form and two end sub-panels of substantially triangular form, each of said first and third end closure panels including a central lug projecting centrally outwardly with respect to its panel and thereby bounding respective recesses in the outermost edge zone of its panel, the second end closure panel including a central lug projecting centrally outwardly with respect to its panel, and outwardly protruding portions at respective opposite sides of said central lug of said second end closure panel for protruding beyond respective adjacent free edges of said first and third end closure panels, the lugs of the first, second and third end closure panels projecting away from a longitudinal centre line of said row of body panels to substantially the same extent as each other, and the fourth end closure panel projecting from said centre line to at least the same extent as do said lugs, characterised in that said outwardly protruding portions have respective edges which commence substantially perpendicularly to said centre line of said row of body panels and continue towards said central lug, According to a third aspect of the present invention, there is provided a packaging container of sheet material, including:

a loop of body portions comprised of first, second, third and fourth body portions, and an end closure including inner and outer, substantially rectangular wall portions extending from respective edges of the first and third body portions, with the outer portion overlapping the inner portion externally of said inner portion, and also including first and second groups of substantially triangular wall portions, the first and second groups of substantially triangular wall portions comprising respective inner, substantially triangular, wall portion extending from the second and fourth body portions, respectively, to respective apices adjacent each other, and respective pairs of outer, substantially triangular, wall portions extending from the respective inner, substantially triangular wall portion, and from the inner and outer, substantially rectangular, wall portion, first and second lugs extending substantially parallelly to each other from the respective pairs of outer, substantially triangular, wall portion at the zones of said respective apices and each folded upon itself, the inner, substantially rectangular, wall portion including a third lug projecting centrally with respect to the remainder of that wall portion and folded back face-to-face upon said remainder and sandwiched between said remainder and said outer, substantially rectangular, wall portion, with the interposition of said first and second lugs between said third lug and said outer, substantially rectangular, wall portion, and the inner, substantially rectangular, wall portion also including protruding portions at respective opposite sides of said third lug and directed away from said third lug, characterised in that said protruding portions are sandwiched between said outer, substantially rectangular, wall portion, on the one hand, and those respective ones of said outer, substantially triangular, wall portions, on the other hand, and have respective lateral edges which commence immediately adjacent to and substantially parallelly with respective fold lines between said outer, substantially rectangular, wall portion, on the one hand, and said respective ones of said outer, substantially triangular wall portions, on the other hand, and continue towards said third lug.

Owing to these two aspects of the invention, it is possible to enhance production and maintenance of self-alignment of the end closure, whilst yet providing for gas-tightness thereof.

According to a fourth aspect of the present invention, there is provided a sheet material blank from which a packaging container is to be made, comprising:

a row of body panels comprised of first, second, third and fourth body panels, and a row of substantially rectangular, end closure panels extending substantially parallelly to said row of body panels and comprised of first, second, third and fourth end closure panels whereof each of the first and third end closure panels has first and second oblique lines of weakness which divide its panel into a central sub-panel of substantially isosceles triangular form and two end sub-panels of substantially triangular form, each of said first and third end closure panels including a central lug projecting centrally outwardly with respect to its panel and thereby bounding respective recesses in the outermost edge zone of its panel, the second end closure panel projecting outwardly, characterised in that respective lines of weakness extend the whole widths of the roots of the central lugs.

According to a fifth aspect of the present invention, there is provided a packaging container of sheet material, including:

a loop of body portions comprised of first, second, third and fourth body portions, and and end closure including inner and outer, substantially rectangular wall portions extending from respective edges of the first and third body portions, with the outer portion overlapping the inner portion externally of said inner portion, and also including first and second groups of substantially triangular wall portions, the first and second groups of substantially triangular wall portions comprising respective inner, substantially triangular, wall portions extending from the second and fourth body portions, respectively, to respective apices adjacent each other and respective pairs of outer, substantially triangular, wall portions extending from the respective inner, substantially triangular, wall portions, and from the inner and outer, substantially rectangular, wall portions, first and second lugs extending substantially parallelly to each other from the respective pairs of outer, substantially triangular, wall portions at the zones of said respective apices and each folded upon itself, and the inner, substantially rectangular, wall portion including a third lug folded back face-to-face upon the remainder of that wall portion and sandwiched between said remainder and said outer, substantially rectangular, wall portion, with the interposition of said first and second lugs between said third lug and said outer, substantially rectangular, wall portion, characterised in that respective lines of weakness, each doubled upon itself, extend the whole widths of the roots of the first and second lugs.

Owing to these two aspects of the invention, it is possible to reduce the risk of malformation of the middle part of the end closure.

Figure 3:
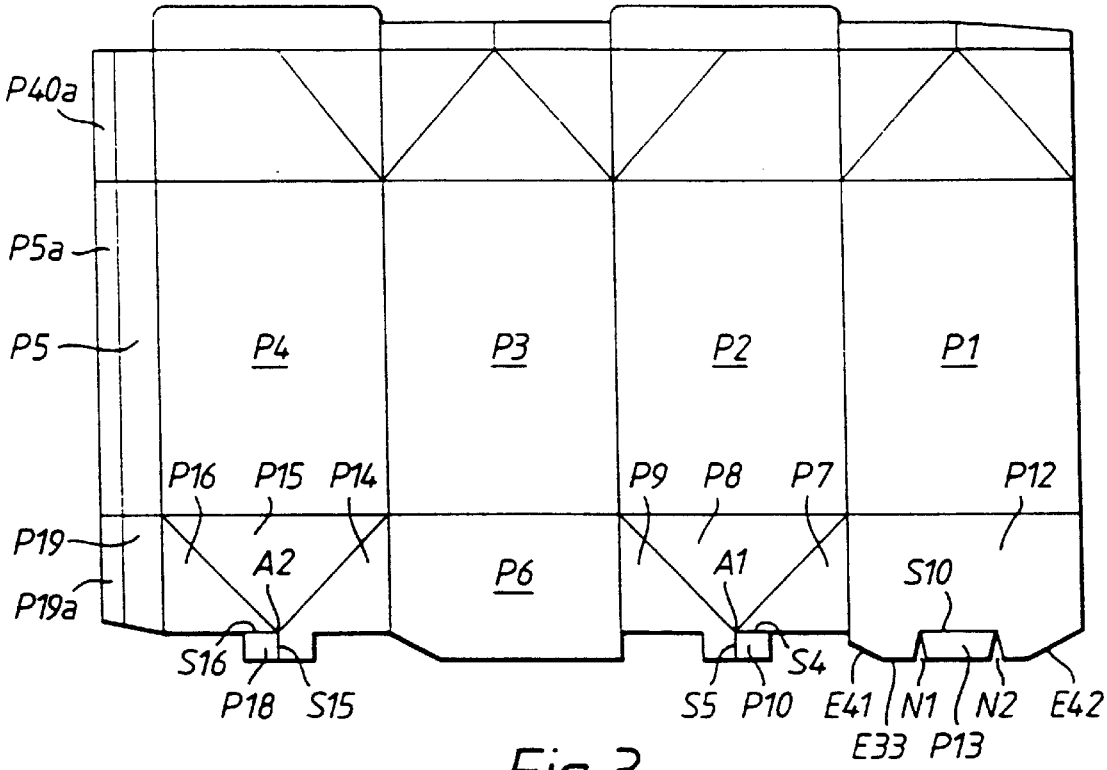
Fig. 3 PRIOR ART
Figure 4:
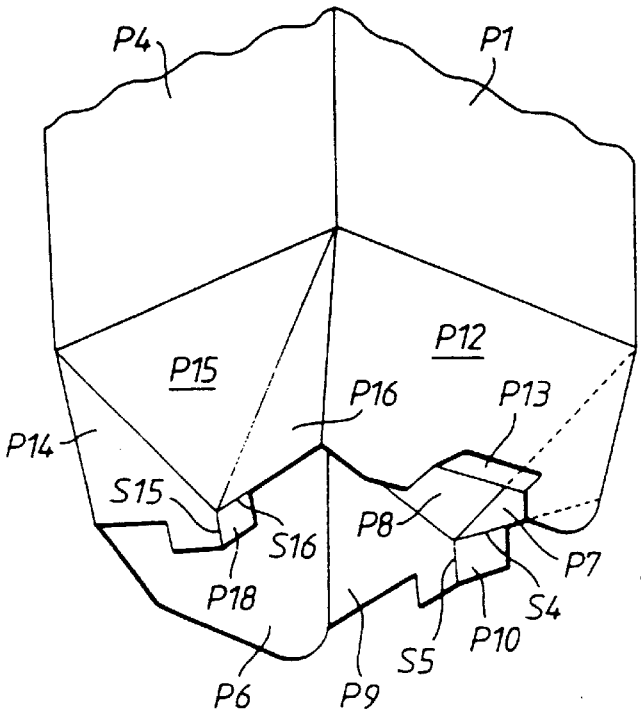
Fig. 4 PRIOR ART
Figure 8:
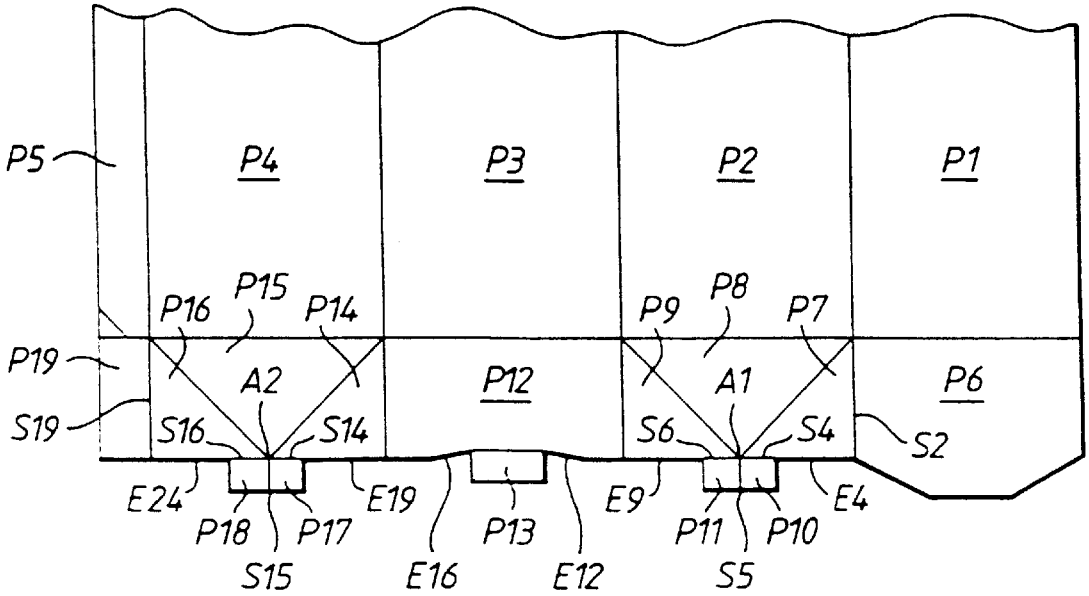
Figure 9:
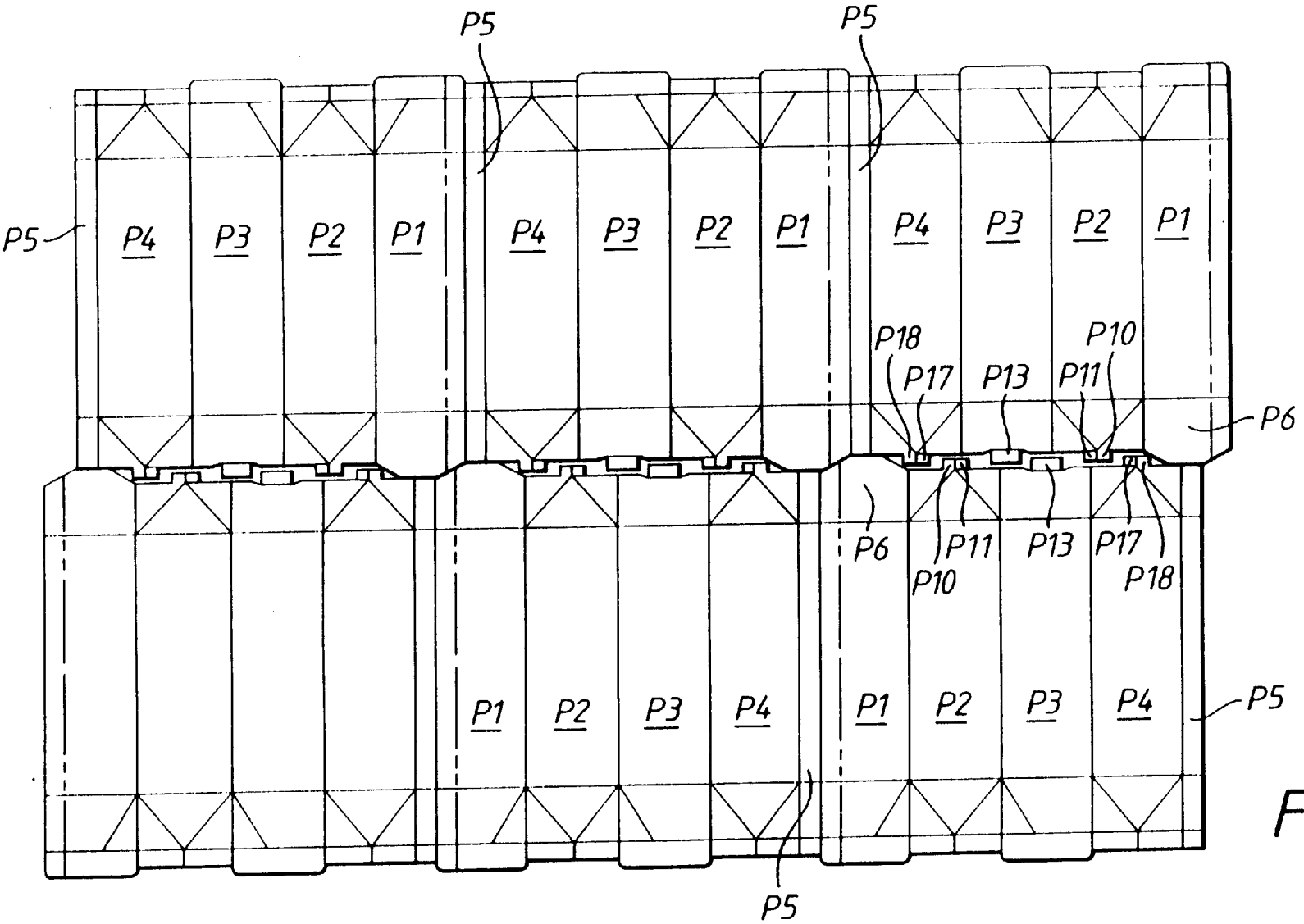
Figure 10:
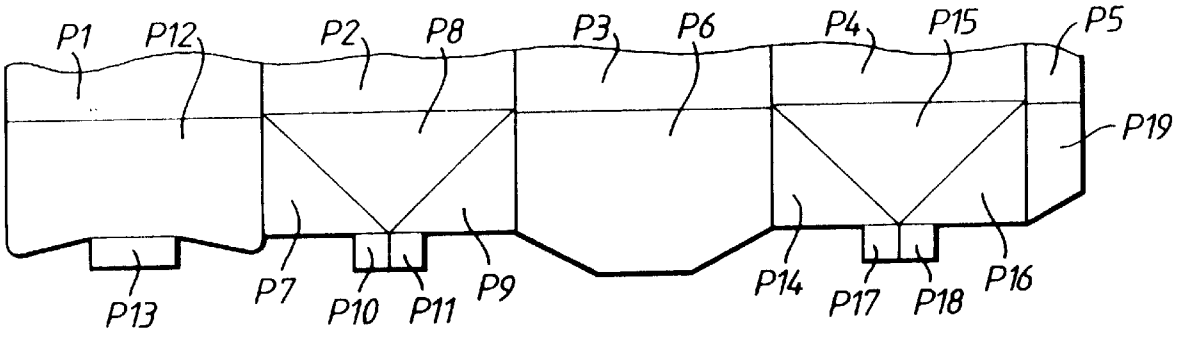
Figure 11:
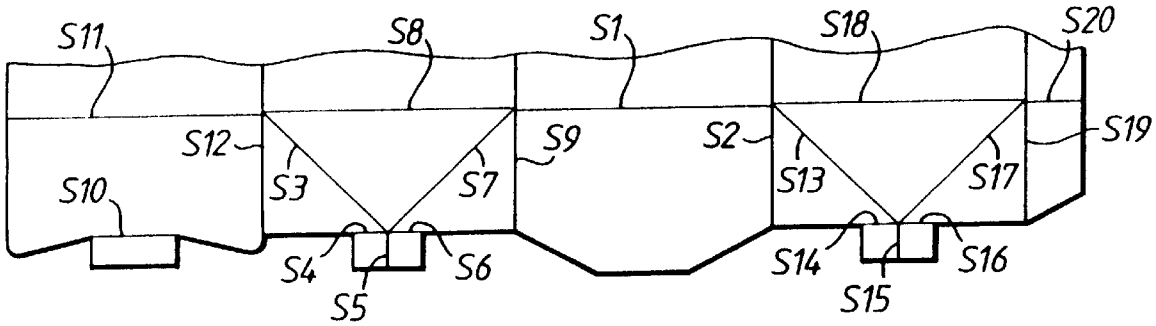
Figure 12:
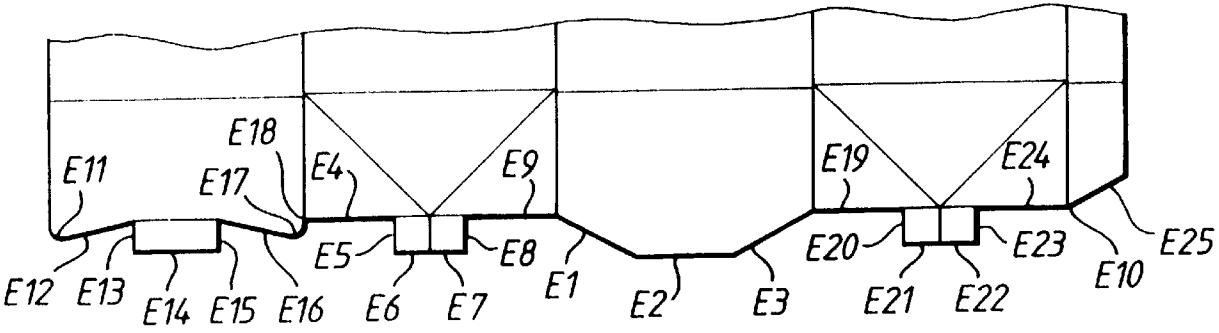
Figure 13:
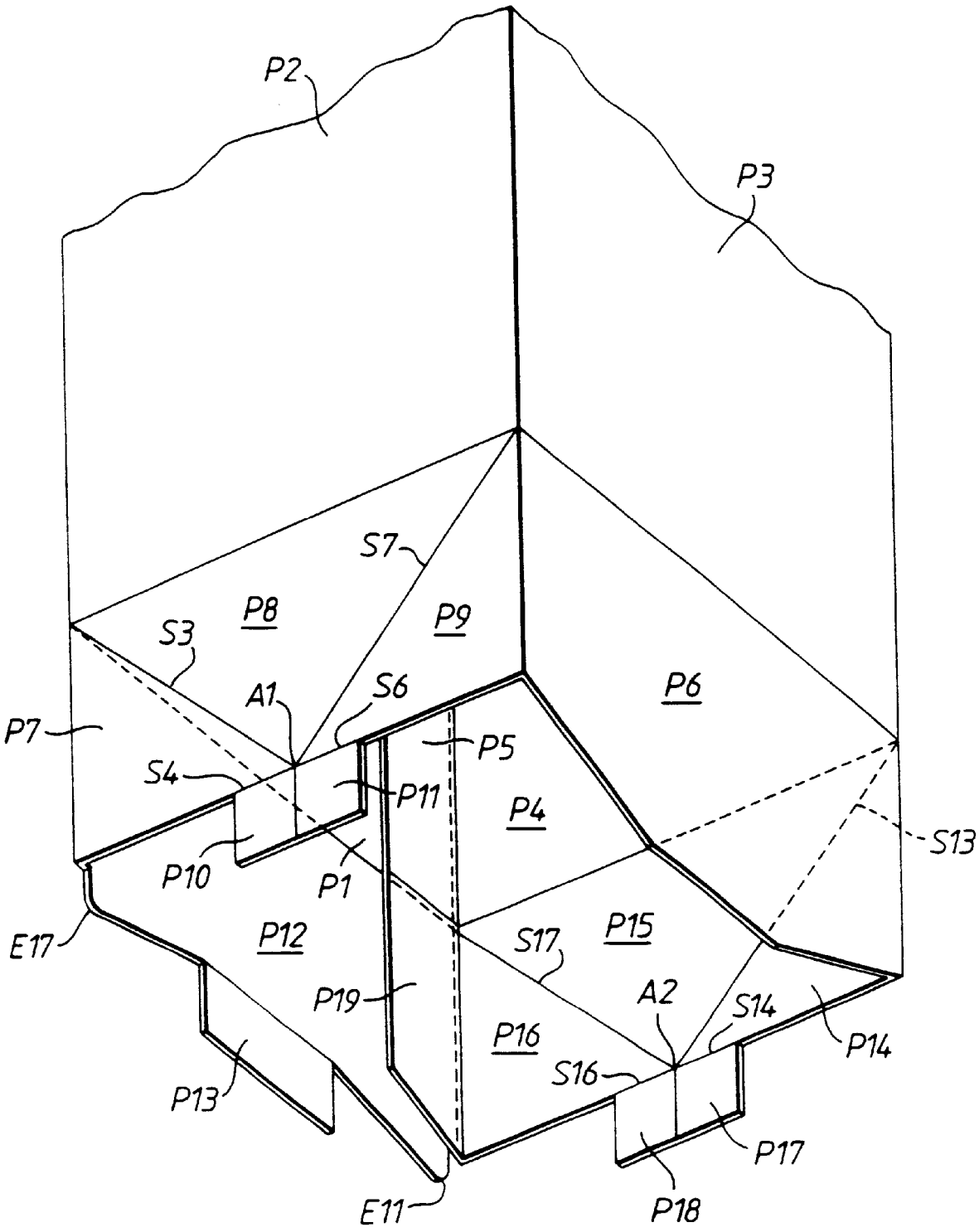
Figure 14:
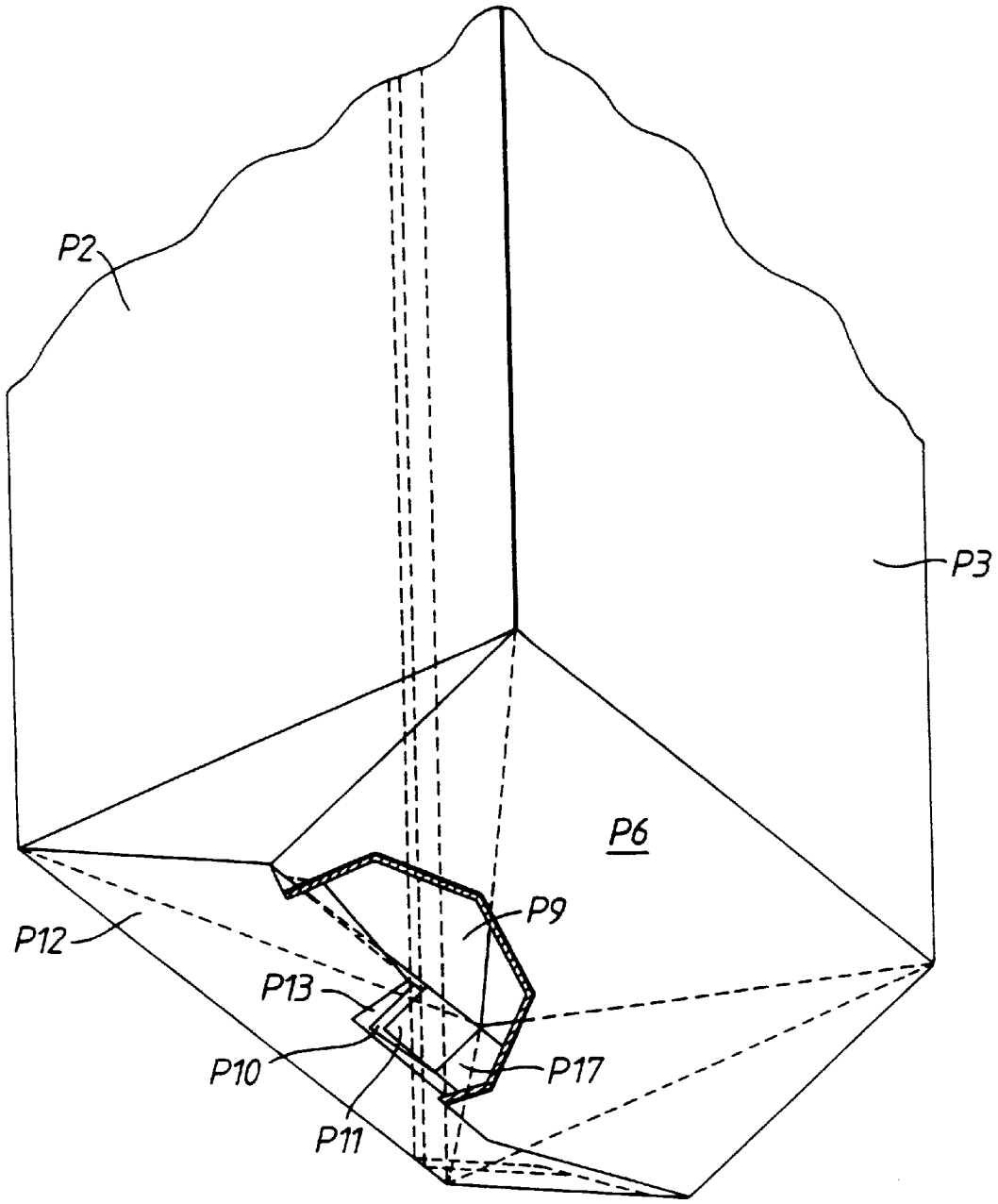
Figure 15:
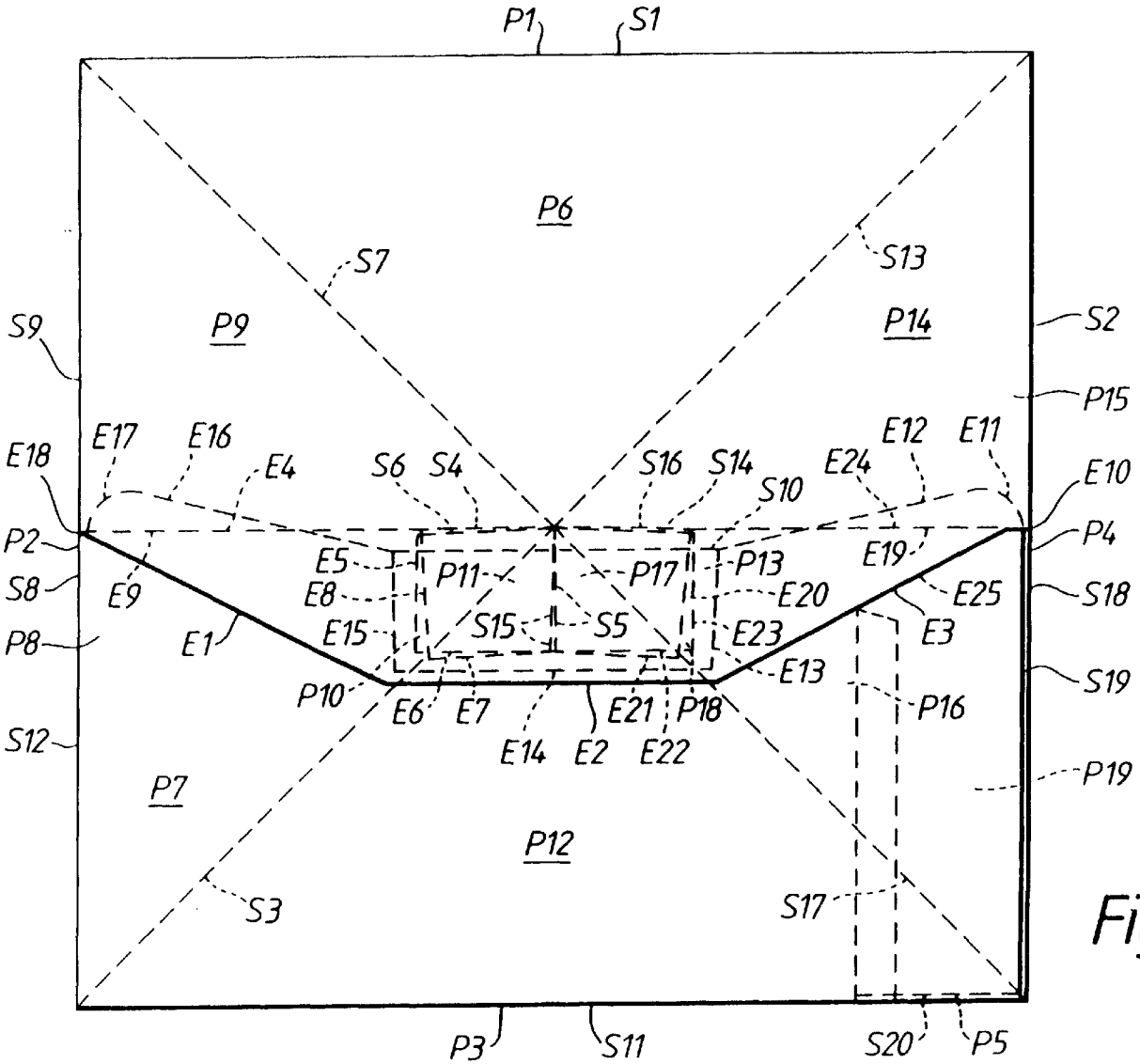
Figure 16:
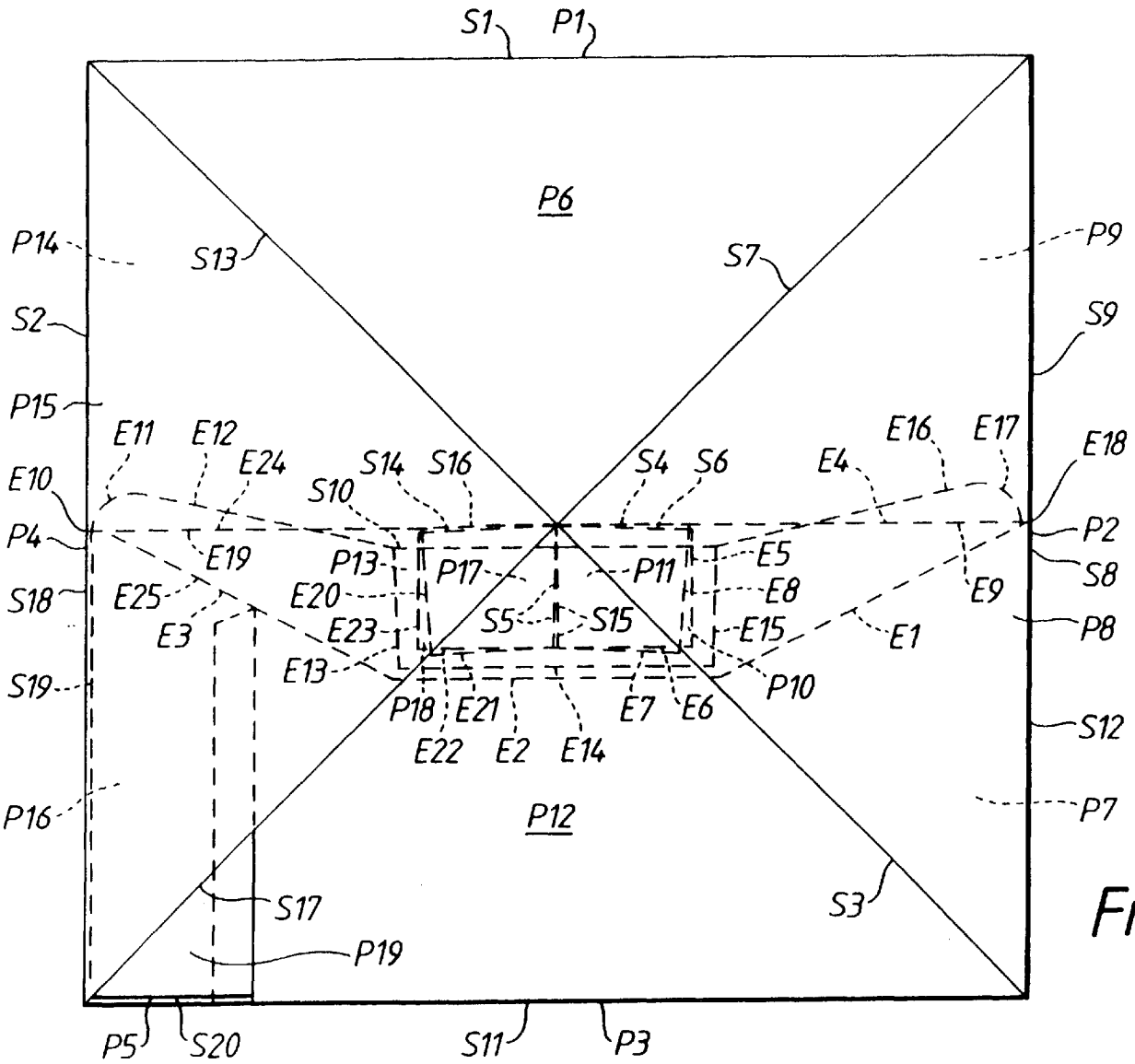
Figure 17:
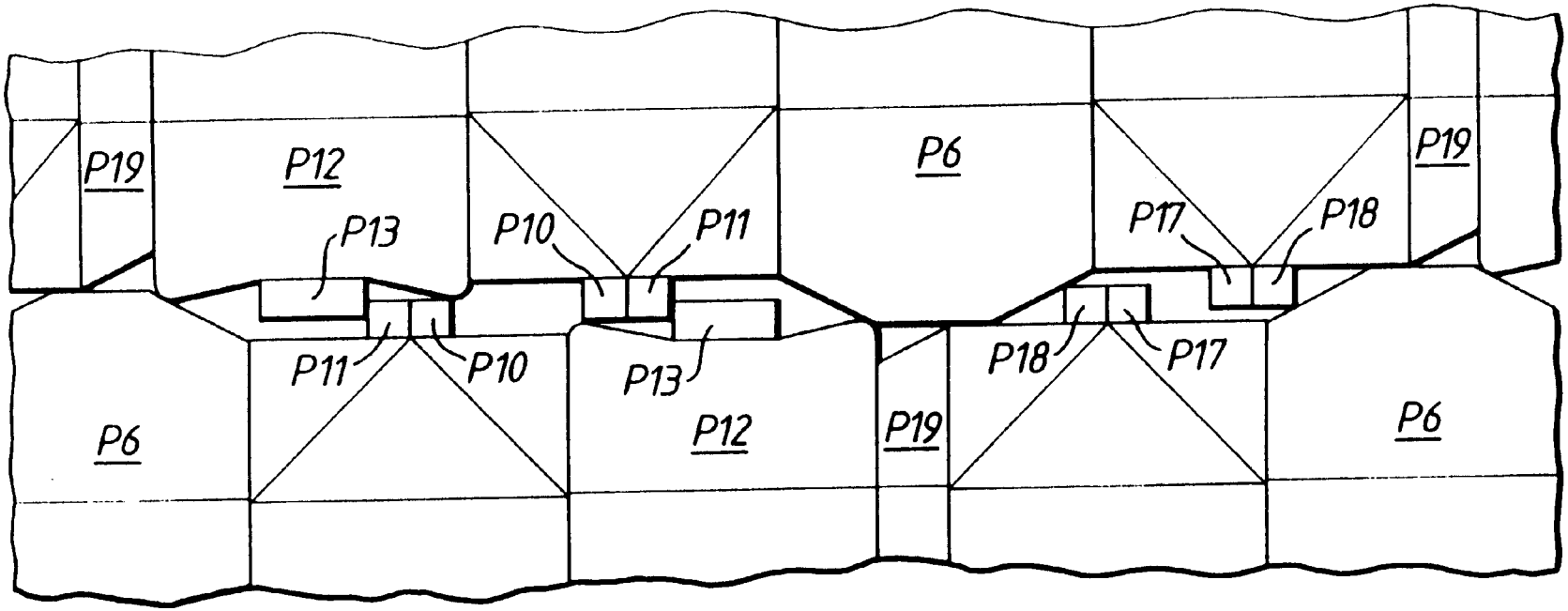

In order that the invention may be clearly understood and readily carried into effect, reference will now be made, by way of example, to the accompanying drawings, in which:

FIG. 1 is a plan view of the inside of a known blank from which a liquid packaging carton is to be made, FIG. 2 is a fragmentary, underneath, perspective view of a bottom end closure of the known carton in a folded condition prior to pressure-sealing, FIG. 3 is a plan view of the inside of another know blank from which another known liquid packaging carton is made, FIG. 4 is a view similar to FIG. 2, but of that other known carton, FIG. 5 is a fragmentary plan view of the outside of a further know bank from which a further known liquid packaging carton is to be made, FIG. 6 is a view similar to FIG. 2 but of that further known carton, FIG. 7 is a view similar to FIG. 5 but of a modified version of that further known blank, FIG. 8 is a fragmentary plan view of the inside of a first embodiment of a blank according to the invention, FIG. 9 is a plan view of the insides of six blanks each according to FIG. 8, as formed by cutting and scoring from a web, FIG. 10 is a plan view of the outside of bottom closure panels of a second embodiment of a blank according to the invention, and particularly identifying the panels, FIG. 11 is the same as FIG. 10, but particularly identifying score lines, FIG. 12 is the same as FIG. 10, but particularly identifying blank edges, FIG. 13 is a fragmentary perspective view of a carton sleeve of the second embodiment of the invention, FIG. 14 is a view similar to FIG. 2, but of the bottom end closure of the carton of the second embodiment of the invention, FIG. 15 is an underneath plan view of the heat-and-pressure-sealed bottom end closure of the carton of the second embodiment of the invention, FIG. 16 is a top plan view of the end closure of FIG. 15, and FIG. 17 is a view corresponding to FIG. 9, but showing six blanks each according to FIG. 10.

FIGS. 1 and 2 illustrate a conventional blank and carton used for products in respect of which gas penetration through the carton inwardly or outwardly is of little concern, for example products to be consumed shortly after packaging. The blank and carton may be made of packaging board polyethylene. The blank comprises a row of body panels P1 to P5 and a parallel row of bottom end closure panels. The latter consists of four substantially rectangular panels P6; P7/P9; and P12; and P14/P16 connected to the respective panels P1 to P4 by respective score lines S1, S8, S11 and S18 parallel to the longitudinal center line of the blank. The panels P7/P9 and P14/P16 comprise two groups of triangular sub-panels P7 to P9 and P14 to P16 of which central, substantially isosceles triangular sub-panels P8 and P15 are connected to the respective panels P2 and P4 by way of the score lines S8 and S18. Connected to the sub-panel P8 by way of respective oblique score lines S3 and S7 are a pair of triangular sub-panels P7 and P9 themselves connected to the panels P6 and P12 by way of respective score lines S2 and S9 perpendicular to the longitudinal center line of the blank. The triangular sub-panel P15 is connected, by way of respective oblique score lines S13 and S17, to the respective triangular sub-panel P14 and P16, which are themselves connected to the panel P12 and a substantially rectangular panel P19 by way of respective score lines S12 and S19 perpendicular to the longitudinal center line of the blank. Also connected to the panels P1 to P5 are respective top end closure obturating panels P30 to P41 and top end closure sealing panels P50 to P56.

As is well known, in forming a filled and sealed carton from the blank, the panels P5, P19, P40, P41 and P56 are heat-and pressure-sealed to the right-hand edge zone of the panels P1, P6, P30, P31 and P50, respectively, to form a carton sleeve with a side seam. The carton sleeve is placed over a mandrel with the bottom end closure panels protruding axially from an axial end face of the mandrel, then the score lines S1, S3, S7, S8, S11, S13, S17, and S18, are pre-broken by turning the panels and substantially-panels P6 to P19 relative to each other, then appropriate zones of the panels and sub-panels P6 to P19 are heated to render them tacky, then the panels and sub-panels P6, P8, P12 and P15 are folded inwards in an appropriate sequence to being about roughly the condition shown in FIG. 2; then a pressure plate is applied to the outer substantially rectangular panel P12 and the inner substantially rectangular panel P6 to press them against the triangular sub-panels P7 and P9 and P14 to P16 and to press all of the bottom end closure panels and sub-panels P6 to P19 between the pressure plate and the mandrel, to pressure-seal them together. Then the bottom-closed carton is forwarded to a top pre-breaking station, where score lines of the top end closure are pre-broken, and is then forwarded to one or more filling stations where the carton is filled with product, for example liquid. The filled carton is then forwarded to a top heating station, where appropriate portions of the panels P50 to P56 are heated and thereby rendered tacky, whereafter the top closure panels P30 to P41 and P50 to P56 are folded inwards and the panels P50 to P56 pressure-sealed together to form a sealing fin.

The panels and sub-panels P6, P7, P9, P12, P14 and P16 have free edges E30 to E35, respectively, which extend parallelly to each other and to the longitudinal center line of the blank. The panel P6 also has free, chamfer edges E36 and E37 which diverge inwardly from the respective ends of the edge E30 and which terminate in free edges E38 and E39 which extend parallel to each other but perpendicularly to the longitudinal center line of the blank. The panel P12 has an oblique free edge E40 extending from one end of the edge E33 to the adjacent end of the score line 12. It will be noted that the edges E30 and E33 protrude beyond the edges E31, E32, E34 and E35, which are co-linear with each other. The dimensions of the panels and sub-panels P6 to P19 are such that the lug of the panel P6 bounded by the edges E30 and E36 to E39 can enter between the panel P12, on the one hand, and the sub-panels P9 and P14, on the other hand and that, when the panels and sub-panels P6 to P19 have become pressed between the pressure plate and the mandrel, the edges E31 and E32 abut each other along their lengths, as do the edges E34 and E35. As the lug bounded by the score lines E30 and E36 to E39 enters between the panel P12 and the sub-panels P9 and P14, at least one of the chamfer edges E36 and E37 acts as a lead-in for the lug, in relation to the folds at the score lines S9 and S12, to give self-alignment of the closure. This self-alignment is enhanced by the edges E31 and E32, and the edges E34 and E35, subsequently abutting each other.

Whereas the blank and carton described with reference to FIGS. 1 and 2 provide a good self-alignment of the bottom end closure, which promotes dimensionally correct sealing of the bottom end closure and also promotes production of a dimensionally correct carton, the middle part of the edge E30 and those portions of the edges E31 and E32 at the apex A1 and the edges E34 and E35 at the apex A2 are exposed to the product and, because they are cut edges, the porous paperboard is also exposed to the product. This has the disadvantage that, at those locations, gases and possibly liquids can penetrate through the carton.

In order to provide a carton having a bottom end closure which is gas-tight relative to the bottom end closure of the carton FIGS. 1 and 2, it is known from U.S. Pat. No. 4,192,446 to provide a blank and carton according to FIGS. 3 and 4. In the blank shown in FIG. 3, the sub-panels P7, P9, P14 and P16 have been prolonged in only the respective zones of the apices A1 and A2 to provide two central lugs which include respective small, rectangular sub-panels P10 and P18 bounded respectively by score lines S5 and S15 extending centrally of the respective lugs from the apices A1 and A2 and score lines S4 and S16 respectively bounding the sub-panels P7 and P16. Formed symmetrically in the edge E33 of the panel P12 are two notches N1 and N2 which leave between them a central lug in the form of a panel P13 bounded by a score line S10 extending between the apices of the notches N1 and N2 and which leave beyond them two outward protrusions bounded by respective chamfer edges E41 and E42. The central lug in the form of the panel P13 is at least as wide as each of the two other central lugs. A conventional skiving strip is formed by the sub-panels P40*a*, P5*a* and P19*a* in FIG. 3. As indicated in FIG. 4, when the bottom end closure is folded inwardly, the panel P13 is turned about the score line S10 back outwardly onto the outside surface of the panel P12, so that there is no longer a cut edge exposed to the product at the middle of the outer edge of the panel P12. Moreover, the small rectangular sub-panels P10 and P18 are folded back onto the outsides of the prolongations of the sub-panels P9 and P14, so that, at the apices A1 and A2 formed by the respective groups of sub-panels P7 to P10 and P14 to P18, there are no longer any cut edges to be exposed to the product in the carton. The two folded central lugs including the sub-panels P10 and P18 come to overlap the panel P13 at its outside and the outermost edge zone of the panel P6 comes to lie on those two lugs. The two protrusions bounded by the edges E41 and E42 and the notches N1 and N2 are inserted between the panels P8 and P9 and the panels P14 and P15, respectively, and the bottom end closure is sealed. However, in this end closure there is practically no self-aligning interaction between the panels P6 and P12. As a result, the sealing of the bottom end closure is too often incorrectly dimensioned and the open-topped carton so produced is also too often incorrectly dimensioned, although, compared with the carton end closure of FIGS. 1 and 2, a relatively good gas-tight sealing of the bottom end closure is obtained provided that the sealing is not incorrectly dimensioned. Yet, as the folded-back panel P13 is being tucked inwards of the two folded lugs, those lugs should be able to adjust their orientation to that of the panel P13; however, the two prolongations of the sub-panels P9 and P14 are resistant to turning relative to the remainders of their panels P9 and P14, with the result that malformation of the central part of the bottom end closure sometimes happens. Moreover, in the blank, the dimensions of those two lugs, the notched outermost edge zone of the panel P12 and the outermost edge zone of the panel P6 are such that they cannot interdigitate with the corresponding items of one or more identical blanks (nor even with the projecting portions of the panels P52 and P53).

Again, in order to provide a carton having a bottom end closure which is gas-tight relative to the bottom end closure of the carton of FIGS. 1 and 2, it is known from GB-A-2176767 to provide a blank and carton according to FIGS. 5 and 6, or a blank and carton of which the blank is according to FIG. 7. In the blank shown in FIG. 5, the panel P12 protrudes to only the same extent as the sub-panels P9 and P14, but from the panel P12 again protrudes a tongue-form panel P13 connected to the panel P12 by a score line S10 parallel to the score line S11, whilst cut-outs are formed in the panel P12 at respective ends of the panel P13 to provide cut, free edges E12 and E16 oblique to the score line S10. Moreover, the sub-panels P7 and P16 are arranged to protrude outwards beyond the respective sub-panels P9 and P14. The protruding portions of the sub-panels P7 and P16 are connected to the respective sub-panels P9 and P14 by way of small rectangular sub-panels P11 and P17, which are connected to the sub-panels P7 and P16 by way of the score lines S5 and S15, respectively, and to the sub-panels P9 and P14 by way of score lines S6 and S14. As indicated in FIG. 6, when the bottom end closure is folded inwardly, the panel P13 is turned about the score line S10 back outwardly onto the outside surface of the panel P12, so that there is no longer a cut edge exposed to the product at the middle of the outer edge of the panel P12. Moreover, the small rectangular sub-panels P11 and P17 are folded back onto the outsides of the prolongations of the sub-panels P7 and P16, so that, at the apices A1 and A2 formed by the respective groups of sub-panels P7 to P11 and P14 to P17, there are no longer any cut edges to be exposed to the product in the carton. However, in this end closure, the panel P6 comes to lie upon the sub-panels P7 and P16, which come to lie upon the panels P12 and P13, and the panel P12 comes to lie upon the sub-panels P8 and P15. This has the disadvantage that there is practically no self-aligning interaction between the panels P6 and P12 nor between the sub-panels P14 and P16 and the sub-panels P7 and P9, respectively. As a result, the sealing of the bottom end closure is too often incorrectly dimensioned and the open-topped carton so produced is also too often incorrectly dimensioned, although, compared with the carton end closure of FIGS. 1 and 2, a relatively good gas-tight sealing of the bottom end closure is obtained provided that the sealing is not incorrectly dimensions. Yet, as the folded-back panel P13 is being tucked inwards of the sub-panels P11 and P17, backed by the outermost edge zones of the sub-panels P7 and P16, those items should be able to adjust their orientation to that of the panel P13; however, the two prolongations of the sub-panels P7 and P16 are resistant to tuning relative to the remainders of their panels P7 and P16, with the result that malformation of the central part of the bottom end closure sometimes happens. Moreover, in the blank, the dimensions of the outermost edge zones of the sub-panels P7 and P16 extended by the sub-panels P11 and P17, the outermost edge zone of the panel P6, and the panel P13, are such that they cannot interdigitate with the corresponding items of one or more identical blanks.

FIG. 7 shows a different arrangement of the parts of the bottom closure and of the side-seal strip P5, P19 et cetera. In spite of this, the same bottom structure is formed on folding as in FIG. 6.

Referring to FIG. 8, in order to retain the relatively good gas-tight property of the bottom end closure of FIG. 4, the central lugs of the substantially rectangular panels P7–P9 and P14 –P19 have been retained, but the score lines S4 and S16 have been extended as respective score lines S6 and S14 to form lines of weakness S4, S6 and S14, S16 across the whole widths of the roots of those two central lugs, leaving respective small rectangular sub-panels P11 and P17 connected to the sub-panels P10 and P18 by the score lines S5 and S15, respectively, and connected to the sub-panels P9 and P14 by way of the score lines S6 and S14, respectively, whereby those two central lugs are better able to adjust to the orientation of the panel P13 while the latter is being tucked inwards of the two lugs; yet the feature of the absence of cut edges from the apices A1 and A2 is retained, and moreover the cut edges E4 and E9 of the sub-panels P7 and P9 come into abutment along their lengths, as do the cut edges E19 and E24 of the sub-panels P14 and P16, when the bottom end closure panels and sub-panels P6 to P19 are pressed together between the pressure plate and the mandrel, so promoting self-aligning of the bottom end closure.

Another advantage of providing only central lugs as prolongations of the panels P7–P9, P12, and P14–P16 is that the bottoms of the blanks can be dimensioned to nest together very closely, as shown in FIG. 9, whereby it is possible to reduce the offcuts from packaging board. As shown in FIG. 9, the nesting consists of interdigitation between the panel P6; the pair of sub-panels P10 and P11; the panel P13; and the pair of sub-panels P17 and P18 of one blank and the pair of sub-panels P17 and P18; the panel P13; the pair of sub-panels P10 and P11; and the panel P6 of another blank, in that order.

The embodiment shown in FIGS. 10 to 17 differs from that shown in FIG. 8 in that edge portions E11 and E17 of the panel P12 near the respective sub-panels P16 and P7 in the side-seemed carton protrude beyond the cut edges E24 and E4 of the sub-panels P16 and P7, respectively. In the side-seamed carton, the edge portions E1 and E17 commence immediately adjacent to and parallelly with the respective score lines S19 and S12 and continue convexly curvedly towards the panel P13. These two, curved, protrusions co-operate with the respective folds provided at the score lines S2 and S9, respectively, between the panel P6 and the sub-panel P14, and between the panel P6 and the sub-panel P9, so as to produce a lead-in of those protrusions to between the respective sub-panels P14 and P9 and the panel P6 shortly before the edges E4 and E9 and the edges E19 and E24 come into abutment with each other and to provide a strut between those folds once the edges E4 and E9 and the edges E19 and E24 have come into abutment with each other. These lead-in and strutting effects thus enhance production and maintenance of self-alignment of the bottom end closure.

FIG. 17 illustrates that blanks according to FIGS. 10 to 12 can be closely nested together bottom-to-bottom, except that in this case the interdigitation by any one blank significantly overlaps two opposite blanks.

Referring particularly to the version of FIGS. 10 to 17, the following advantages are obtained in the following ways:

Advantages I—a relatively gas-tight bottom end closure. This is obtained because the bottom end closure is so designed that there is no contact between the paperboard of the bottom end closure and the product. In this respect, the following features are of significance:

(1) the skived longitudinal edge of the seal strip.

(2) Sub-panels P10, P11, P17 and P18 protect the tips of the sub-panels P7, P9, P14 and P16.

(3) Panel P13 protects the edge of panel P12.

(4) The tallest panel P6 covers the edges of the other panels from below.

(5) The scorelines S5 and S15 and the edges E4, E9, E10, E18, E19, E24 and E25 are so positioned relative to the longitudinal centreline of the blank as to cause strain on abutting edges in the end closure.

(6) The relative positions of the score line S10, on the one hand, and the score lines S4, S6, S14 and S16, on the other hand, are adjusted in dependence upon various properties of the blank, for example the thickness of the board.

(7) The edge E25 is so positioned as to cause strain against the edge E3 through the panel P12 when pressure-sealing occurs.

Advantage II—a self-aligning bottom configuration. The following features are of significance:

(1) It is self-aligning in two direction perpendicular to each other and both contained in the plane of the closure. Such self-alignment is ensured by edges meeting each other and latching in exact positions:

in one direction:

the edge E4 meets the edge E9 the edge E19 meets the edge E24 the folds at the score lines S4 and S16 meet the fold at the score line S10.

in the other direction:

the fold at the score line S2 is directed outwardly by the edge E11 to come to abut against the edge E10 the fold produced at the score line S9 is directed by the edge E17 to abut against the edge by edge E17 to abut against the edge E18.

again, the edge E25 is directed and pushed out by the edge E3 under pressure (2) See feature I(5)

(3) See feature I(6)

Advantage III—it is easier to fold the bottom panels together. The features II(1) to II(4) are significant. A further significant feature is that the score lines S6 and S14 encourage symmetrical folding.

Advantage IV—cracking, under folding and heat- and pressure-sealing, of any barrier layer (for example aluminium or EVOH) included in the board is discouraged. The following features are of significance:

(1) The panel P19 is folded alongside the planar panel P12 rather than the folded panel P7–P9 or P14–P16.

(2) The distance between the score lines S4 and S16 and the score line S10 is in accordance with the angles of folding and properties of the blank, to assure tightness and folding on the centreline of the bottom configuration.

(3) The widths and depths of the score lines are appropriate to the angles of folding and properties of the blank.

Advantage V—Score lines reduce cracking at the folds and promote better sealing. The following features are significant:

(1) The score lines S6 and S14 serve to relieve strain on the sub-panels P9 and P11, and P14 and P17, in one sense.

(2) The forming of the score lines S6 and S14 stretches the material at those score lines, and so extends the sub-panels P11 and P17 when pressure-sealing occurs, for better sealing and compensation for folding radius.

Advantage VI—economical use of packaging board. The following features are significant:

(1) The bottom edge configuration makes it possible to interdigitate bottom edges of blanks, as shown in FIGS. 7 and 14, and so reduce offcuts.

(2) Self-aligning of the folded bottom panels into exactly the same position and configuration time-after-time avoids having overlarge bottom panels to ensure tightness.

(3) Self-alignment of the closure permits the use of simpler mechanisms for folding the bottom panels.

(4) The overlap of the bottom panels can be reduced to just sufficient to ensure folding, control of the bottom end closure configuration and gas-tightness.

Advantage VII—good stability of the carton. The feature VI(4) is significant because it enables the bottom end closure to be pressure-sealed so as to be flat at its outside.

I claim:

1. A sheet material blank from which a packaging container is to be made, comprising:

a row of body panels comprised of first, second, third and fourth body panels, said row having a longitudinal center line extending in a direction, and a row of substantially rectangular, end closure panels extending substantially parallelly to said row of body panels and comprised of first, second, third and fourth end closure panels whereof each of the first and third end closure panels has first and second oblique lines of weakness which divide its panel into a central sub-panel of substantially isosceles triangular form and two end sub-panels of substantially triangular form, each of said first and third end closure panels including a central lug projecting outwardly away from said center line with respect to its panel and thereby bounding respective recesses in the outermost edge zone of its panel, the second end closure panel including a central lug projecting outwardly away from said center line with respect to its panel, the lugs of the first, second and third end closure panels projecting away from said center line to substantially the same extent as each other, and the fourth end closure panel projecting from said center line to at least the same extent as do said lugs and there having an edge zone which is furthest from said longitudinal center line, wherein said central lug of said second end closure panel bounds respective recesses in the outermost edge zone of its panel, with those recesses being bounded also by respective edges of said second end closure panel which extend in substantially said direction, and wherein said lugs of the first, second and third end closure panels and the edge zone of said fourth end closure panel which is furthest from said longitudinal center line are so dimensioned that lugs of first, second and third end closure panels and edge zones of fourth end closure panels furthest from a longitudinal center line of rows of body panels of a first row of blanks identical to said blank are able to interdigitate with corresponding lugs and corresponding edge zones of a second row of blanks each identical to said blank.

2. A sheet material blank according to claim 1, wherein said second end closure panel includes outwardly protruding portions at respective opposite sides of said central lug of said second end closure panel for protruding beyond respective adjacent free edges of said first and third end closure panels, and wherein said outwardly protruding portions have respective edges which commence substantially perpendicularly to said center line of said row of body panels and continue towards said central lug.

3. A sheet material blank according to claim 2, wherein said respective edges of said outwardly protruding portions continue convexly curvedly towards said central lug.

4. A sheet material blank according to claim 1, 2 or 3, wherein respective lines of weakness extend the whole widths of roots of the central lugs of the first and the third end closure panels.

5. A packaging container of sheet material, including:

a loop of body portions comprised of first, second, third and fourth body portions, and an end closure including inner and outer, substantially rectangular wall portions extending from respective edges of the first and third body portions, with the outer portion overlapping the inner portion externally of said inner portion, and also including first and second groups of substantially triangular wall portions, the first and second groups of substantially triangular wall portions comprising respective inner, substantially triangular, wall portions extending from the second and fourth body portions, respectively, to respective apices adjacent each other, and respective pairs of outer, substantially triangular, wall portions extending from the respective inner, substantially triangular wall portions, and from the inner and outer, substantially rectangular, wall portions, first and second lugs extending substantially parallelly to each other from the respective pairs of outer, substantially triangular, wall portions at the zones of said respective apices and each folded upon itself, the inner, substantially rectangular, wall portion including a third lug projecting centrally with respect to the remainder of that wall portion and folded back face-to-face upon said remainder and sandwiched between said remainder and said outer, substantially rectangular, wall portion, with interposition of said first and second lugs between said third lug and said outer, substantially rectangular, wall portion, and the inner, substantially rectangular, wall portion also including protruding portions at respective opposite sides of the said third lug and directed away from said third lug, wherein said protruding portions are sandwiched between said outer, substantially rectangular, wall portion and those ones of said outer, substantially triangular, wall portions extending from said outer, substantially rectangular, wall portion and have respective lateral edges which commence immediately adjacent to and substantially parallelly with respective fold lines between said outer, substantially rectangular, wall portion and said ones of said outer, substantially triangular wall portions, and continue towards said third lug.

6. A packaging container according to claim 5, wherein respective edges of the substantially triangular wall portions of each pair of outer, substantially triangular, wall portions substantially abut each other.

7. A packaging container according to claim 5 or 6, wherein said respective lateral edges continue convexly curvedly towards said third lug.

8. A packaging container according to claim 5, 6 or 7, wherein respective lines of weakness, each doubled upon itself, extend the whole widths of roots of the first and second lugs.

* * * * *